US010548372B2

(12) United States Patent
Chamberlain

(10) Patent No.: US 10,548,372 B2
(45) Date of Patent: Feb. 4, 2020

(54) SHOE LACE HOLDER

(71) Applicant: LACEJAM LIMITED, Upper Hutt (NZ)

(72) Inventor: Peter Brett Chamberlain, Upper Hutt (NZ)

(73) Assignee: LASEJAM Limited, Upper Hutt (NZ)

( * ) Notice: Subject to any disclaimer, the term of this patent is extended or adjusted under 35 U.S.C. 154(b) by 26 days.

(21) Appl. No.: 15/021,701

(22) PCT Filed: Aug. 28, 2014

(86) PCT No.: PCT/NZ2014/000179
§ 371 (c)(1),
(2) Date: Mar. 13, 2016

(87) PCT Pub. No.: WO2015/047106
PCT Pub. Date: Apr. 2, 2015

(65) Prior Publication Data

US 2016/0219984 A1 Aug. 4, 2016

(30) Foreign Application Priority Data

Sep. 26, 2013 (NZ) ..... 615965

(51) Int. Cl.
*A43C 7/00* (2006.01)
*A43C 1/00* (2006.01)

(52) U.S. Cl.
CPC ..... *A43C 7/00* (2013.01); *A43C 1/00* (2013.01); *Y10T 24/3724* (2015.01); *Y10T 24/3918* (2015.01)

(58) Field of Classification Search
CPC ..... A43C 7/00; A43C 1/00; Y10T 24/3724; Y10T 24/3916; Y10T 24/3703; Y10T 24/3918
See application file for complete search history.

(56) References Cited

U.S. PATENT DOCUMENTS 1,806,162 A * 5/1931 Hahn ..... A43C 7/04 24/129 B
3,675,276 A * 7/1972 Nuse ..... A01K 91/04 24/129 B (Continued)

FOREIGN PATENT DOCUMENTS

GB 1457313 A * 12/1976 ..... A43C 7/00

*Primary Examiner* — Robert Sandy
*Assistant Examiner* — Michael S Lee
(74) *Attorney, Agent, or Firm* — Inventa Capital PLC

(57) ABSTRACT

A shoe lace holder (LH) to assist in the tying of shoe laces (L) and to prevent shoe laces inadvertently coming undone during use is disclosed. The shoelace holder includes a unitary body having top and bottom surfaces defined by a front edge, a back edge and side edges. The body includes at least one first hole (7) and at least one second hole (8), two slots (3, 4), which extend in opposite directions relative to each other, and at least two further holes (11, 12) spaced apart from each other. The holes allow a shoe lace to pass through, and the slots are adapted to engage a portion of the shoe lace there in. When attached to a shoe a shoe's laces are interwoven through the respective holes and slots to prevent the lace inadvertently untying in use. A method of securing a shoe lace to the shoe lace holder is also disclosed.

7 Claims, 6 Drawing Sheets

(56) References Cited

U.S. PATENT DOCUMENTS

| | | | | | |
|---|---|---|---|---|---|
| 3,765,060 | A * | 10/1973 | Sharick | F16G 11/12 | 135/119 |
| 5,979,028 | A * | 11/1999 | Hicks | A43B 3/0078 | 24/130 |
| 6,094,787 | A * | 8/2000 | Chang | A43C 1/00 | 24/712.1 |
| 6,167,598 | B1 * | 1/2001 | Pransky | A43C 7/08 | 24/712.9 |
| 7,806,909 | B2 * | 10/2010 | Fallin | A61B 17/0487 | 24/129 A |
| D718,064 | S * | 11/2014 | Chamberlain | D6/315 | |
| 2004/0261235 | A1 * | 12/2004 | Funk | A43C 7/00 | 24/712.9 |
| 2006/0190041 | A1 * | 8/2006 | Fallin | A61B 17/0401 | 606/232 |
| 2007/0180665 | A1 * | 8/2007 | Sween | B65H 75/06 | 24/130 |
| 2010/0269373 | A1 * | 10/2010 | Pirkle | A43C 7/00 | 36/136 |
| 2014/0020263 | A1 * | 1/2014 | Theuvenet | A43B 3/0005 | 36/50.1 |
| 2016/0025186 | A1 * | 1/2016 | DeLuca | F16G 11/103 | 24/130 |
| 2016/0029745 | A1 * | 2/2016 | Atherinos | A43C 7/00 | 24/712.1 |
| 2016/0286900 | A1 * | 10/2016 | Parker | A43C 7/00 | |

* cited by examiner

SHOE LACE HOLDER

RELATED APPLICATIONS

This application claims priority to International Application No. PCT/NZ2014/000179 filed on Aug. 28, 2014, which claims priority to New Zealand Patent Application No. 615965 filed on Sep. 26, 2013, and incorporated herewith by reference in its entirety.

FIELD OF THE INVENTION

The invention relates to a Shoe Lace Holder to assist in the tying of shoe laces and to prevent shoe laces inadvertently coming undone during use.

BACKGROUND OF INVENTION

The tying of shoe laces can be problematic to some people, especially kids or those medically or mentally impaired. As well shoe laces can come undone, even if tied correctly, during everyday activities such as walking and playing sports. It not uncommon during sports games for shoe laces to come undone leading to the player effected having to re-tie the shoe lace meaning that the player affected is out of the game or the game is stopped while the effected person is re-tying the shoe lace. Also it can be difficult to re tie a shoe lace during an outdoor game where the shoe and shoe laces are covered in mud or if the persons fingers are numb from the cold. Sometimes the laces get wet, causing them to come undone, and once wet, it can be virtually impossible to re-tie the lace to not come undone again.

A shoe lace is tied traditionally in the following manner: The two ends of a shoe lace are crossed over and under each other to tighten the shoe to the foot. Then one end of the lace is used to form a loop. The other end of the remaining lace is then wrapped around the base of the lace that is looped, then looped itself, and fed through a gap made by the lace looping around the first loop, and then the two loops are pulled tight to form a knot that holds the shoe lace in the locked position. A shoe lace tied traditionally, whether for everyday use and/or sports, can and does come undone accidentally and unintentionally. Even the use of a double bow does not eliminate the possibility of the shoe lace accidentally becoming undone.

There are also a number of other options for holding a shoe lace in place, most of which require one or more moving parts, springs, chips and the like. The shape and cumbersome nature of the alternatives also introduce some factors which counter the usefulness and effective final use of the apparatus, in that in some instances, not just limited to sports, the shoe lace could still accidentally come undone. Moving parts can break and wear out and some shapes are not suitable for contact sports where injury could be caused by the use of such an apparatus, rendering the use of the apparatus illegal or useless to that particular sport and/or use.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the invention to provide a Shoe Lace Holder that ameliorates some of the disadvantages and limitations of the known art or at least provide the public with a useful choice.

SUMMARY OF INVENTION

In a first aspect the invention resides in a shoe lace holder to assist in the tying of shoe laces and to prevent shoe laces inadvertently coming undone during use, the shoe lace holder includes a unitary body member having no moving parts and having a top surface and bottom surface defined by a front edge, a back edge and side edges; the body member including: a) at least one first central hole adapted to accommodate and to allow a shoe lace to pass there through; b) two slots, where each slot[H] are aligned relative to another and each extends in the opposite direction relative to the other, each slots extends toward a side edge of the body member, each slot is configured and adapted to engage a portion of the lace therein in and each slot is aligned with and extends in a direction outwardly from the first central hole; c) at least one second central hole adapted to accommodate and to allow a shoe lace to pass there through; and d) at least two further holes spaced apart from one another towards and adjacent a side edge of the body member, the two further holes adapted to accommodate and allow a shoe lace to pass there through, wherein, when attached to a shoe, the shoe lace holder in combination with the respective holes and slots engaging with the lace interweaved therein prevents a shoe lace from inadvertently untying during use of the shoe by a user.

Preferably, the slots are friction engaging slots such that a portion of the shoe lace is frictionally held within the slots when pulled there through toward the end of the slots distal from the first central opening.

Preferably, there are two first central holes situated spaced and adjacent one another, one of the slots extends outwardly from one first central hole toward one side edge of the body member and the other slot extends outwardly from the other first central hole toward the other side edge of the body member.

Preferably, there are two second central holes situated spaced apart and adjacent one another.

Preferably, the two second central holes and the two further holes are co axially aligned and one of the further holes is situated between one of the second central holes and one side edge and the other further hole is situated between the other of the second central holes and the other side edge.

Preferably, each slot adjacent the side edge has an opening, wherein the each opening is adapted to allow a portion of the lace to pass from the above the top surface of the body member to underneath the bottom surface of the body member.

Preferably, the body member is arcuate in shape wherein the bottom surface is concave such that the camber of the body portion substantially matches the shape of the top part of a shoe and/or foot of a user.

In a second aspect the invention resides in method of securing a shoe lace to a shoe lace holder, wherein the method includes: a) taking the two portions of the lace from the top of the shoe and inserting from underneath the shoe lace holder the lace portions through at least one first central hole in the shoe lace holder; b) pulling one portion of the lace in a slot extending outwardly away from the first central hole towards a first side edge of the shoe lace holder and pulling the other portion of the lace in another slot extending outwardly away from the central hole towards a second side edge of the shoe lace holder, both slots extend in an opposite direction to one another; c) pulling each lace portion downwardly through respective openings at the ends of the slots distal from the first central hole opening so that the lace is then effectively underneath a bottom surface of the shoe lace holder; d) taking each lace portion across the bottom surface of shoe lace holder to and up through at least one second central hole; and e) forming a loop above a top surface of the shoe lace holder as the respective lace ends are passed downwardly through respective further holes that are spaced apart from one another.

Preferably, the slots are friction engaging slots such that a portion of the shoe lace is frictionally held within the slots when pulled there through toward the end of the slots distal from the first central opening.

Preferably, there are two first central holes situated spaced and adjacent one another, one of the slots extends outwardly from one first central hole toward one side edge of the body member and the other slot extends outwardly from the other first central hole toward the other side edge of the body member, wherein one lace portion is inserted and extends through one of the first central holes and the other lace portion is inserted and extends through the other of the first central holes.

Preferably, there are two second central holes situated spaced apart and adjacent one another. Preferably, the two second central holes and the two further holes are aligned and one of the further holes is situated between one of the second central holes and one side edge and the other further hole is situated between the other of the second central holes and the other side edge, wherein one lace portion is inserted and extends through one of the second central holes and one of the further two holes and the other lace portion is inserted and extends through the other of the second central holes and the other hole of the further two holes.

Preferably, each slot adjacent the side edge has an opening, wherein the each opening is adapted to allow a portion of the lace to pass from the above the top surface of the body member to underneath the bottom surface of the body member.

Preferably, the body member is arcuate in shape wherein the bottom surface is concave such that the camber of the body portion substantially matches the shape of the top part of a shoe and/or foot of a user. Any other aspects herein described

BRIEF DESCRIPTION OF FIGURES

The invention will now be described, by way of example only, by reference to the accompanying drawings.

DESCRIPTION OF THE PREFERRED EMBODIMENT(S)

The following description will describe the invention in relation to preferred embodiments of the invention, namely a shoe lace holder. The invention is in no way limited to these preferred embodiments as they are purely to exemplify the invention only and that possible variations and modifications would be readily apparent without departing from the scope of the invention.

The shoe lace holder of the invention uses motion and forces in a unique way. The laces are fed through the shoe lace holder to literally "jam" the lace in place and prevent the lace from accidentally coming undone during sports and everyday use. With no moving parts, the shoe lace holder severely limits time wastage in tying and re-tying shoe laces. The shoe lace holder saves parents, referees, sports people and people in everyday life from annoying delays in re-tying shoe laces.

Figure 1:
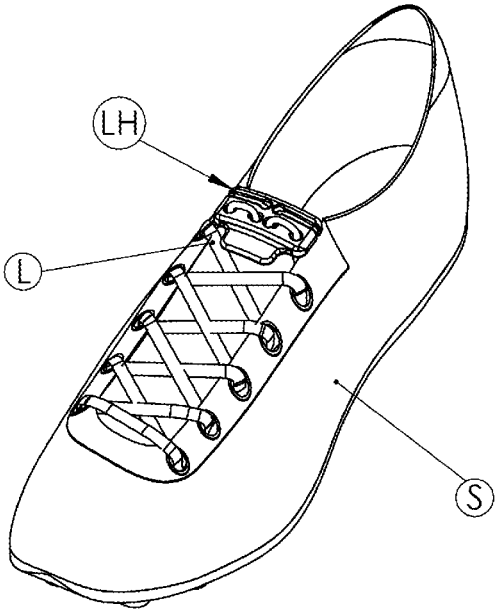
FIG. 1 shows a shoe with a shoe lace holder in accordance to an embodiment of the invention.
Figure 2:
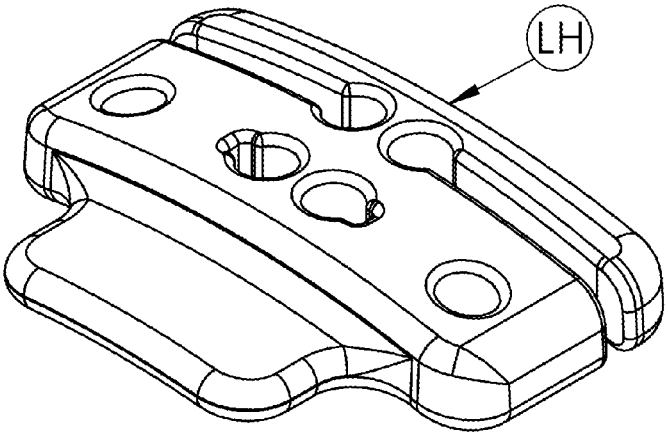
FIG. 2 shows a perspective view of the shoe lace holder as shown in FIG. 1.
Figure 3:
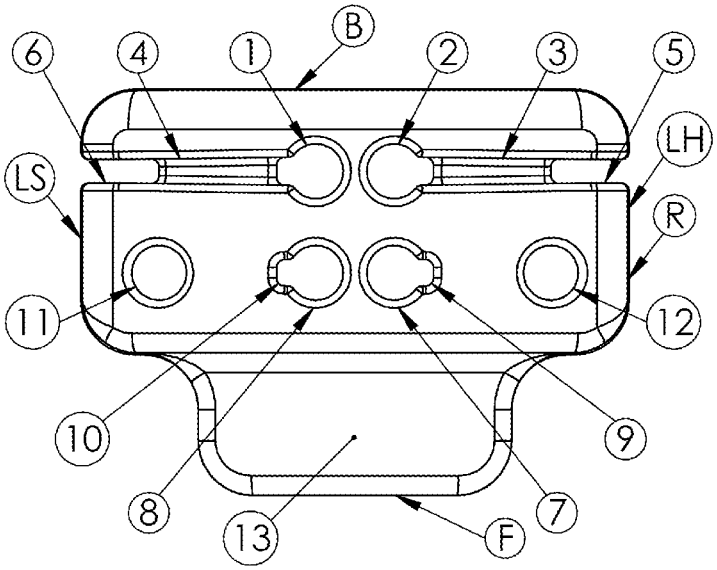
FIG. 3 shows a top view of the shoe lace holder as shown in FIG. 2.
Figure 4:
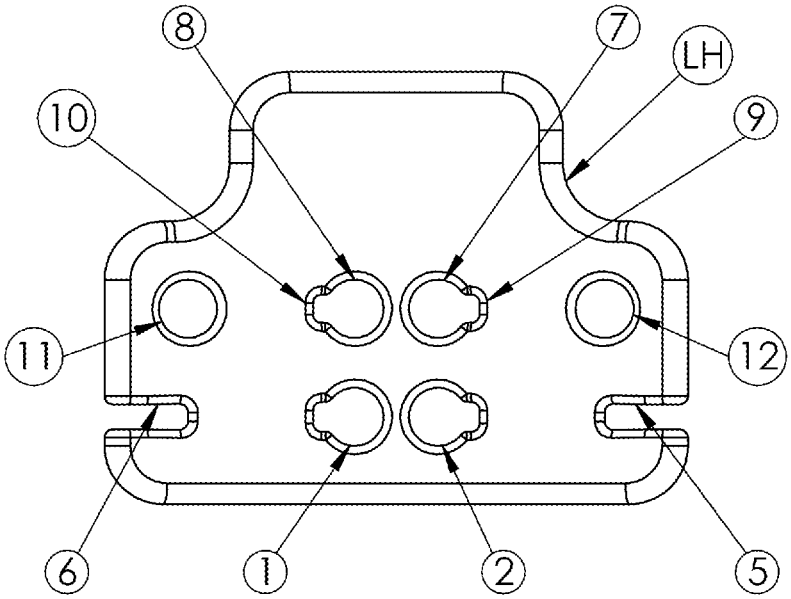
FIG. 4 shows a bottom view of the shoe lace holder as shown in FIG. 2.
Figure 5:
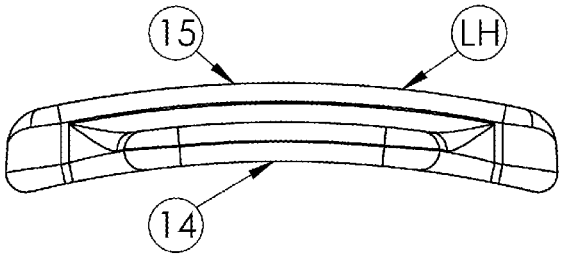
FIG. 5 shows a front view of the shoe lace holder as shown in FIG. 2.
Figure 6:
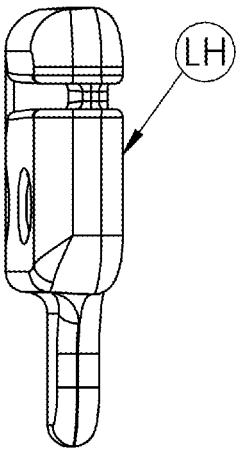
FIG. 6 shows a side view of the shoe lace holder as shown in FIG. 2.

The shoe lace holder of the invention will now be described with reference to FIGS. 1 to 9. FIG. 1 shoes a shoe S with the laces L held by a shoe lace holder LH. FIGS. 2 to 9 show the shoe lace holder LH in more detail. The shoe lace holder LH is a single, one-piece body member with no moving parts, which holds laces in place and keeps the shoe tight during everyday use and in all sports activities. As can be seen in FIGS. 2 to 4 the one-piece body member of shoe lace holder LH has front edge F, back edge B, side edges LS, R, top surface 15 and bottom surface 14. A portion 13 adjacent the front F of the shoe lace holder SH is dimensioned and sized forming a tab like shape on which the top surface of the tab 13 a logo can be situated thereon. The body member has two sets of central holes 1, 2 and 7, 8 and two further holes 11, 12 one situated side edge R and the other situated adjacent side edge LS. The holes 1, 2, 7, 8, 11 and 12 allow the portions of the lace to be threaded there through. It is envisaged that the two sets of central holes 1, 2 and 7, 8 could each be replaced by a single central opening (not shown) each that is dimensioned and sized to allow two portions of the lace be situated and passed there through.

The first sets of holes 1, 2 each have a slot 3, 4 extending outwardly there from toward the side edge LS, R of the shoe lace holder LH. The slots 3, 4 are dimensioned and sized such that the lace is able to be jammed therein in order to retain the lace within the show lace holder LH. The slots 3, 4 can include lace gripping features such as teeth, camming protrusions or the like. Also the slots 3, 4 could have reducing width with respect to increasing depth such that as the lace is pulled into deeper into the slots the lace is caused to be jammed therein. Similarly the slot could have reducing width with increasing distance from the central openings such as the lace is pulled within the slot toward the end distal from the central opening the lace is jammed therein. The ends of the slots 3, 4 distal from the central openings 1, 2 open to openings 5, 6 to allow the lace to pulled and guided to underneath the shoe lace holder LH.

The second set of central openings 7, 8 each have a slot 9. 10 where each slot 9, 10 slightly extends in a direction toward a respective side edge LS, R of the shoe lace holder LH. The two further holes 11, 12, one that is situated adjacent side edge R and the other situated adjacent side edge LS are coaxially aligned with and share the same longitudinal axes of the second set of central holes 7, 8, however it is envisaged that these two holes could be situated elsewhere on the shoe lace holder without departing from the scope of the invention.

Figure 7:
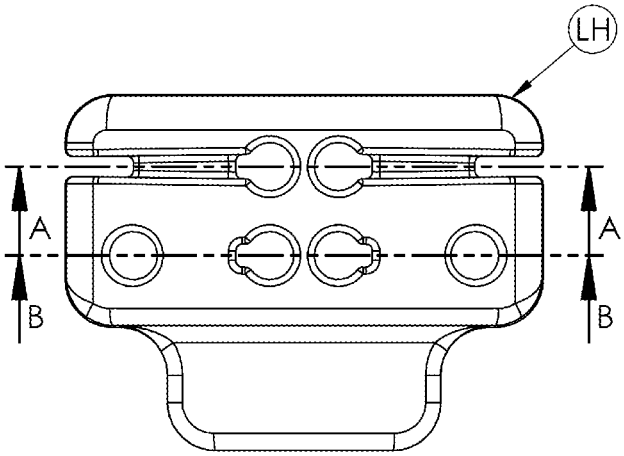
FIG. 7 shows a top view of the shoe lace holder as shown in FIG. 2 with sectional lines.
Figure 8:
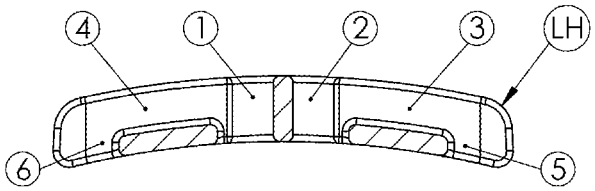
FIG. 8 shows a cross sectional view of the shoe lace holder along sectional lines A-A as shown in FIG. 7.
Figure 9:
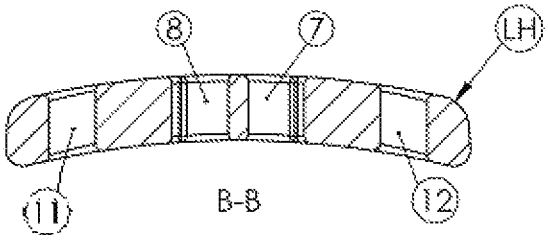
FIG. 9 shows a cross sectional view of the shoe lace holder along sectional lines B-B as shown in FIG. 7.
Figure 10:
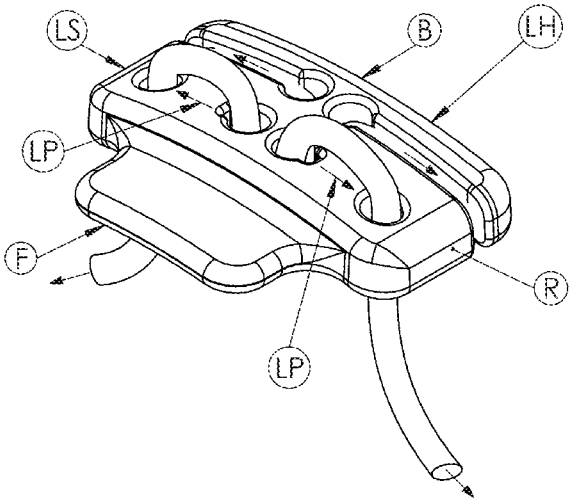
FIG. 10 shows a perspective view of the shoe lace holder with shoe laces as shown in FIG. 1.
Figure 11:
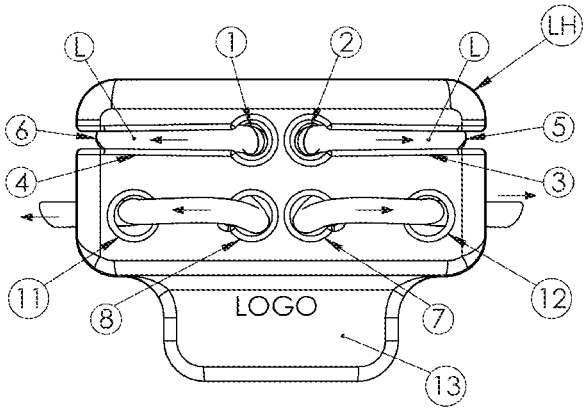
FIG. 11 shows a top view of the shoe lace holder as shown in FIG. 10.
Figure 12:
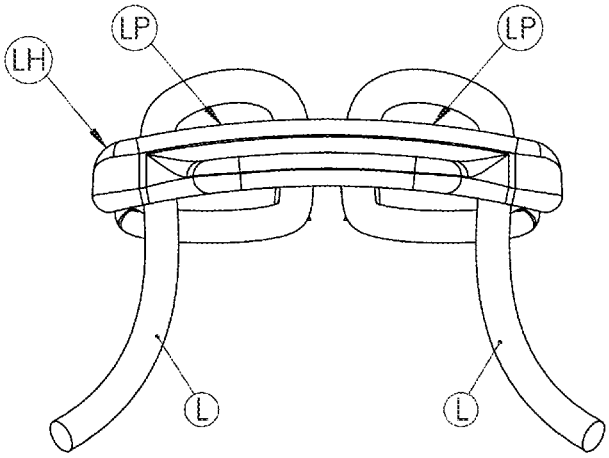
FIG. 12 shows a front view of the shoe lace holder as shown in FIG. 10.
Figure 13:
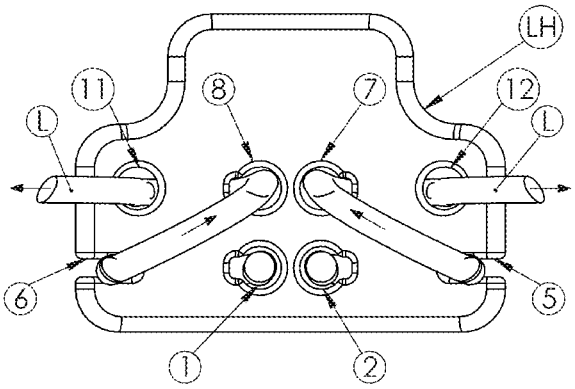
FIG. 13 shows a bottom view of the shoe lace holder as shown in FIG. 10.
Figure 14:
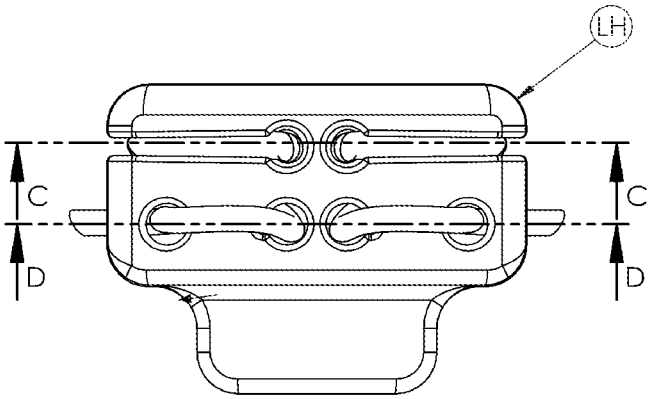
FIG. 14 shows a top view of the shoe lace holder as shown in FIG. 10 with sectional lines.
Figure 15:
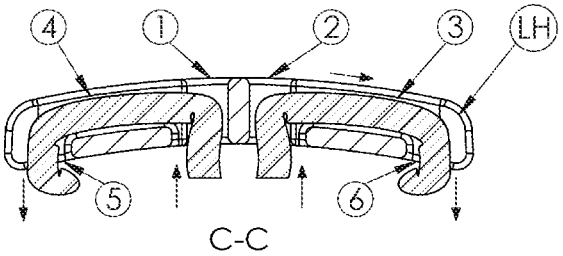
FIG. 15 shows a cross sectional view of the shoe lace holder along sectional lines C-C as shown in FIG. 10.
Figure 16:
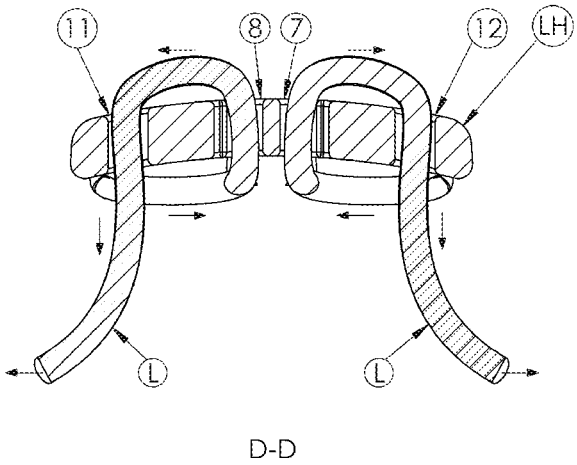
FIG. 16 shows a cross sectional view of the shoe lace holder along sectional lines D-D as shown in FIG. 10.

FIGS. 8 and 9 show respective cross-section of the shoe lace holder LH along sectional lines A-A and B-B shown in FIG. 7. FIG. 8 shows clearly feature of the combination of the first set of central openings 1, 2 slots 3, 4 and openings 5, 6. FIG. 9 shows clearly the combination of the features of the second set of central openings 7, 8 and further holes 11. 12. Both FIGS. 8, 9 clearly show a preferred optimum shape of the shoe lace holder LH. The shoe lace holder as shown has actuate in shape such the bottom surface is concave and dimensioned and configured to ensures the shoe lace holder has a camber to match the shape of the top of a shoe and/or foot, and ensures that there are no unnecessary edges or protrusions to catch, damage or injure during contact sports.

The invention will now be described in reference to FIGS. 10 to 16 in which the shoe lace holder LH is shown with lace L inserted and threaded therein. The arrows indicate the direction in which the lace L is inserted and threaded through the respective holes, slots and openings.

Note that laces do not need cross over before entering the holes 1, 2 because the shoe lace holder LH relies solely on the physics of force and friction of the lace within slots 3, 4 to hold the lace in place, as opposed to the traditional idea that a lace needs to be tied in some way to prevent it from coming untied. However the laces could be crossed over without departing from the scope of the invention, but is considered to be unnecessary.

The lace from the shoe is inserted through the first set of central holes 1, 2 and then engages with the slots 3, 4 to hold the lace L in place by way a friction. Then each lace L passes over the respective edge LS, R via openings 5, 6 and the laces are directed underneath to the further set of central holes 8, 7, brought up again to the top of the shoe lace holder LH, with the remaining tail of the laces passing into each respective further hole 11, 12 hole adjacent to the respective edges LS, R of the shoe lace holder LH, leaving a loop and/or being pulled flat and the tail of the laces sitting flat on the shoe surface beneath the shoe lace holder LH.

The shoe lace cannot be loosened or become untied accidentally as the procedure for securing the lace in the holder would need to be done simultaneously in the steps outlined to secure the lace, which would be impossible. How it works: a) Lace L comes from the top of the shoe and does not cross over, i.e. the lace goes up holes 1, 2 adjacent to and on the side that the lace is closest to; b) Each lace end is then pulled down into slots 3, 4; c) Lace is then pulled through opening 5, 6 so that the lace is then effectively on the bottom surface 14 of the shoe lace holder; d) Each lace end then goes across the bottom surface 14 of shoe lace holder to and through holes 7, 8 respectively and passed through into slots 9, 10; e) Forming a loop above the top surface 15 of the shoe lace holder LH as the respective lace ends are passed through holes 11, 12; To undo the shoe lace holder the steps 1 to 5 are reversed.

Some of the advantages of the shoe lace holder are as follows: a) One piece b) No moving parts c) Low cost to manufacture d) Can be coloured to suit applications e) Can be used on all sorts of shoes f) Can be used on different types of laces without alteration g) Cambered to suit foot shape h) No need to cross laces over at any stage i) Negates the need to having to actually tie laces The Invention may also broadly be said to consist in the parts, elements and features referred or indicated in the specification, individually or collectively, and any or all combinations of any of two or more parts, elements, members or features and where specific integers are mentioned herein which have known equivalents such equivalents are deemed to be incorporated herein as if individually set forth. Whilst the invention as described in relation to holding of shoe laces, it is envisaged with our departing from the scope that the shoe lace holder could be used in other applications where laces or tie cords are to be tied and held in place such as other apparel including coats with pull ties or curtains or any other applications in which laces or cords are to be tied and held in place. The examples and the particular proportions set forth are intended to be illustrative only and are thus non-limiting.

The invention has been described with particular reference to certain embodiments thereof. It will be understood that various modifications can be made to the above-mentioned embodiment without departing from the ambit of the invention. The skilled reader will also understand the concept of what is meant by purposive construction.

It will also be understood that where a product, method or process as herein described or claimed and that is sold incomplete, as individual components or steps, or as a "Kit of Parts", that such exploitation will fall within the ambit of this invention even though there may not be any claim to a kit of parts included in the following claims.

What I claim is:

1. A method of securing a shoe lace to a shoe lace holder, said the method includes a) taking two portions of the lace from the top of the shoe and inserting from underneath the shoe lace holder the lace portions through at least one first central hole in the shoe lace holder;

b) pulling one portion of the lace in a slot extending outwardly away from the first central hole towards a first side edge of the shoe lace holder and pulling the other portion of the lace in another slot extending outwardly away from the central hole towards a second side edge of the shoe lace holder such that a portion of the lace is frictionally engaged and held within the slots so as to prevent the shoe lace from inadvertently untying during use of the shoe by a user, both slots extend in an opposite direction to one another;

c) pulling each lace portion downwardly through respective openings at the ends of the slots distal from the first central hole opening so that the lace is then effectively underneath a bottom surface of the shoe lace holder;

d) taking each lace portion across the bottom surface of shoe lace holder to and up through at least one second central hole; and e) forming a loop above a top surface of the shoe lace holder as the respective lace ends are passed downwardly through respective further holes that are spaced apart from one another.

2. The method as claimed in claim 1, wherein the slots are friction engaging slots such that a portion of the shoe lace is frictionally held within the slots when pulled there through toward the end of the slots distal from the first central opening.

3. The method as claimed in claim 1, wherein there are two first central holes situated spaced and adjacent one another, one of the slots extends outwardly from one first central hole toward one side edge of the body member and the other slot extends outwardly from the other first central hole toward the other side edge of the body member, wherein one lace portion is inserted and extends through one of the first central holes and the other lace portion is inserted and extends through the other of the first central holes.

4. The method as claimed in claim 1, wherein there are two second central holes situated spaced apart and adjacent one another.

5. The method as claimed in claim 4, wherein the two second central holes and the two further holes are aligned and one of the further holes is situated between one of the second central holes and one side edge and the other further hole is situated between the other of the second central holes and the other side edge, wherein one lace portion is inserted and extends through one of the second central holes and one of the further two holes and the other lace portion is inserted and extends through the other of the second central holes and the other hole of the further two holes.

6. The method as claimed in claim 1, wherein, each slot adjacent the side edge has an opening, wherein the each opening is adapted to allow a portion of the lace to pass from the above the top surface of the body member to underneath the bottom surface of the body member.

7. The method as claimed in claim 1, wherein, the body member is arcuate in shape wherein the bottom surface is concave such that the camber of the body portion substantially matches the shape of the top part of a shoe and/or foot of a user.

* * * * *